US009738487B2

(12) United States Patent
Gaumann

(10) Patent No.: US 9,738,487 B2
(45) Date of Patent: Aug. 22, 2017

(54) UNWINDING MEANS

(71) Applicant: Joern Gaumann, Dortmund (DE)

(72) Inventor: Joern Gaumann, Dortmund (DE)

(73) Assignee: GMS GmbH, Dortmund (DE)

( * ) Notice: Subject to any disclaimer, the term of this patent is extended or adjusted under 35 U.S.C. 154(b) by 238 days.

(21) Appl. No.: 14/401,262

(22) PCT Filed: Sep. 26, 2012

(86) PCT No.: PCT/EP2012/068933
§ 371 (c)(1),
(2) Date: Nov. 14, 2014

(87) PCT Pub. No.: WO2013/185853
PCT Pub. Date: Dec. 19, 2013

(65) Prior Publication Data

US 2015/0122936 A1 May 7, 2015

(30) Foreign Application Priority Data

Jun. 11, 2012 (DE) ..... 10 2012 105 024

(51) Int. Cl.
*B65H 75/40* (2006.01)
*B65H 35/00* (2006.01)

(52) U.S. Cl.
CPC ..... *B65H 75/406* (2013.01); *B65H 35/002* (2013.01); *B65H 2701/1752* (2013.01)

(58) Field of Classification Search
CPC ..... B65H 35/002; B65H 35/0086; B65H 2701/1752; B65H 2701/1944; B65H 75/16; B65H 75/185; B65H 75/406; Y10T 83/896
See application file for complete search history.

(56) References Cited

U.S. PATENT DOCUMENTS 3,032,283 A * 5/1962 Wooster ..... A47K 10/40 242/596.7
3,991,878 A 11/1976 Serio, Jr. et al.
4,905,923 A * 3/1990 Dudley ..... B65D 85/672 206/408
5,806,786 A 9/1998 Abe et al.
7,424,843 B2 * 9/2008 Guillory ..... B26D 1/045 225/39

(Continued)

FOREIGN PATENT DOCUMENTS

JP 63-105630 U 7/1988
JP 2000-109065 A 4/2000

OTHER PUBLICATIONS

International Search Report of PCT/EP2012/068933, mailed Feb. 13, 2013.

*Primary Examiner* — William A Rivera
(74) *Attorney, Agent, or Firm* — Collard & Roe, P.C.

(57) ABSTRACT

An unwinder for a sheet material has a housing and has crosspieces arranged laterally in the housing. To ensure the functionality of the unwinder even in the case of relatively large winding cores or of relatively large rollers, the crosspiece is connected, in a releasable and non-releasable manner, to an accommodating element of which the surface-area portions, which correspond to the crosspiece, enclose the crosspiece and have accommodating surfaces for the product which is to be unwound.

8 Claims, 3 Drawing Sheets

(56) References Cited

U.S. PATENT DOCUMENTS

Figure 1:
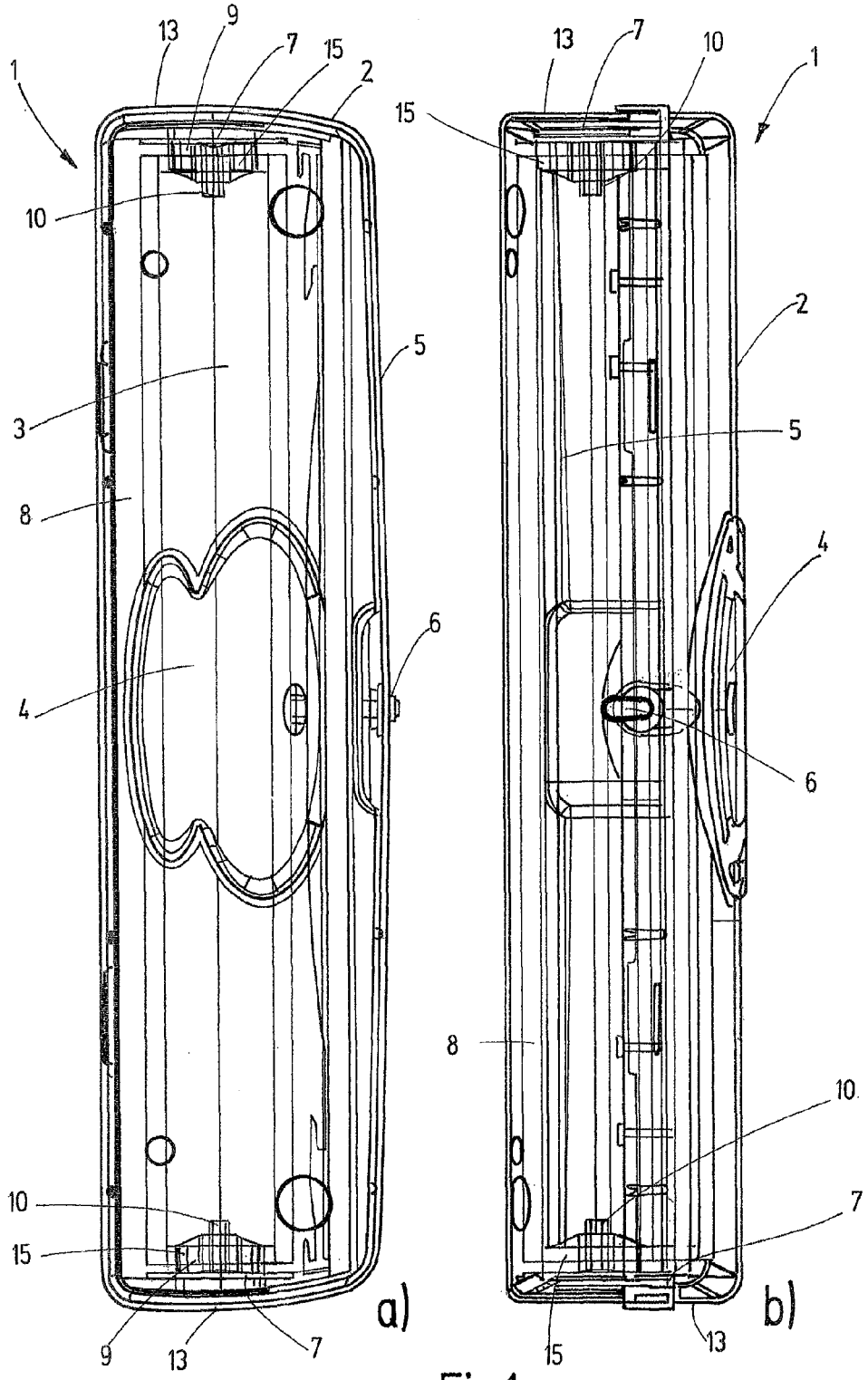

| | | | | |
|---|---|---|---|---|
| 7,975,957 | B2 * | 7/2011 | Lind | A47K 10/36 242/129.51 |
| 7,988,085 | B2 * | 8/2011 | Cattacin | A47K 10/3836 242/596.7 |
| 2003/0178462 | A1 | 9/2003 | Huang | |
| 2006/0278751 | A1 * | 12/2006 | Chen | B65H 75/185 242/588.2 |
| 2007/0063092 | A1 * | 3/2007 | Zevin | B65H 16/06 242/571.5 |
| 2007/0075180 | A1 * | 4/2007 | Morand | A47K 10/40 242/596.7 |
| 2008/0098868 | A1 | 5/2008 | Guillory | |

* cited by examiner

UNWINDING MEANS

CROSS REFERENCE TO RELATED APPLICATIONS

This application is the National Stage of PCT/EP2012/068933 filed on Sep. 26, 2012, which claims priority under 35 U.S.C. §119 of German Application No. 10 2012 105 024.4 filed on Jun. 11, 2012, the disclosure of which is incorporated by reference. The international application under PCT article 21(2) was not published in English.

The invention relates to an unwinder, particularly for films, having a housing and having crosspieces disposed laterally in the housing.

Unwinders of the type stated initially are used, in many cases, in packaging of goods or products of all kinds, particularly when it is a matter of packaging the goods and products in film or paper.

For this purpose, the unwinders known from the state of the art have a housing part that also encloses a region of the accommodation and cutting apparatus. In this connection, the housing part, which is generally produced from plastic, is dimensioned in such a manner that it reaches beyond the lateral face sides of a roll, for example a film roll.

The unwinders have a winding core that is laid laterally so as to rotate, by way of crosspieces that project into the winding core. For this purpose, the previously known unwinders generally have a disk at their two face ends, which is connected with the crosspiece in centered manner, so that the roll is held in place between the two crosspieces by means of pushing the winding core onto the crosspieces.

Unwinders of the type stated initially are furthermore provided with a hinged lid and a slide slot, on the front side, which is longer than the width of the product to be unwound, for example a film, or has a length that corresponds to the width of the product.

The method of functioning of the unwinders of the type stated initially is structured such that after the roll has been laid into the housing, a piece of the film end is pulled out as needed (with one hand), in order to cut the piece of the film end in question off from the roll by means of the cutting apparatus. For this purpose, the hinged lid is pressed down, in order to bring about a clean cut of the film.

In this connection, the winding core rotates about the crosspieces. In this connection, the winding core is held in place with an almost precise fit, in other words with a certain play between winding core and crosspieces.

It has been found that winding cores can have country-specific diameters, which are larger than the diameters of conventional crosspieces, particularly in the case of unwinders used in Asia and North America. However, this has the disadvantage that too much play exists between crosspiece and winding core, so that the rotational movement of the core and therefore the unwinding process are impaired.

It is therefore the task of the present invention to further develop an unwinder of the type stated initially, in such a manner that the functionality of the unwinders is guaranteed even for larger winding cores or larger rolls.

This task is accomplished with the unwinder described herein. Advantageous embodiments are also described herein.

The invention provides that the crosspiece is provided with an accommodation element, the surface sections of which, corresponding to the crosspiece, enclose the crosspiece in releasable or non-releasable manner, and have accommodation surfaces for the product to be unwound.

It is the fundamental idea of the invention to increase the diameter of the crosspiece, which is required for accommodation of the product to be unwound or the winding core, by means of a supplemental piece that encloses a conventional crosspiece that accommodates the winding core or the product to be unwound.

This accommodation element can be configured in one piece with a conventional, standardized crosspiece, during the course of new production of an unwinder.

Alternatively, however, it is also possible to push the accommodation element onto the crosspiece, by means of an axial relative displacement that takes place with regard to a conventional crosspiece, so that the accommodation element lies on the crosspiece in releasable and planar manner.

It is the advantage of the invention that the diameter of a conventional crosspiece of a common unwinder can be expanded, right from the start or subsequently, so that a winding core or a product to be unwound can also be adapted to country-specific diameters, independent of the crosspiece thickness.

In order to cover a plurality of paper rolls and film rolls having different dimensions, it is advantageous if the housing has a length between 335 mm and 345 mm, preferably at least 340 mm, a width between 835 mm and 845 mm, preferably at least 840 mm, and a height between 695 mm and 705 mm, preferably at least 700 mm. It has been found that by means of the selection of these dimensions, a plurality of unwinders from different manufacturers and vendors can be used. It also contributes to this that the crosspiece advantageously has a length between 14.5 mm and 15.5 mm, preferably 15 mm, and the disk has a diameter between 44.5 mm and 45.5 mm, preferably 45 mm.

A practicable variant of the invention provides that the accommodation element has a length between 9 mm and 10 mm, preferably 9.5 mm, so that the end region of the crosspiece, facing away from the disk, stands free.

An advantageous embodiment of the invention provides that the accommodation element has arc-shaped projections—similar to a paddle wheel. In this connection, the projections can be composed of plastic, so that the projections are flexible and there adapt even to slight changes of a diameter of winding cores. In this connection, the width of the projections preferably amounts to between 9 mm and 10 mm, preferably 9.5 mm.

A diameter between 30 mm and 40 mm, preferably 35 mm, has proven itself as a proven dimension for the diameter of the accommodation element, which can accommodate a plurality of paper rolls and film rolls.

In order to guarantee easy use of the unwinder, a further practicable variant of the invention provides that the disk and/or the crosspiece and/or the accommodation element are releasably connected with one another. In this way, undesirable dirt locations can also be eliminated; this are situated, for example, in the transition region between crosspiece and disk.

Figure 2:
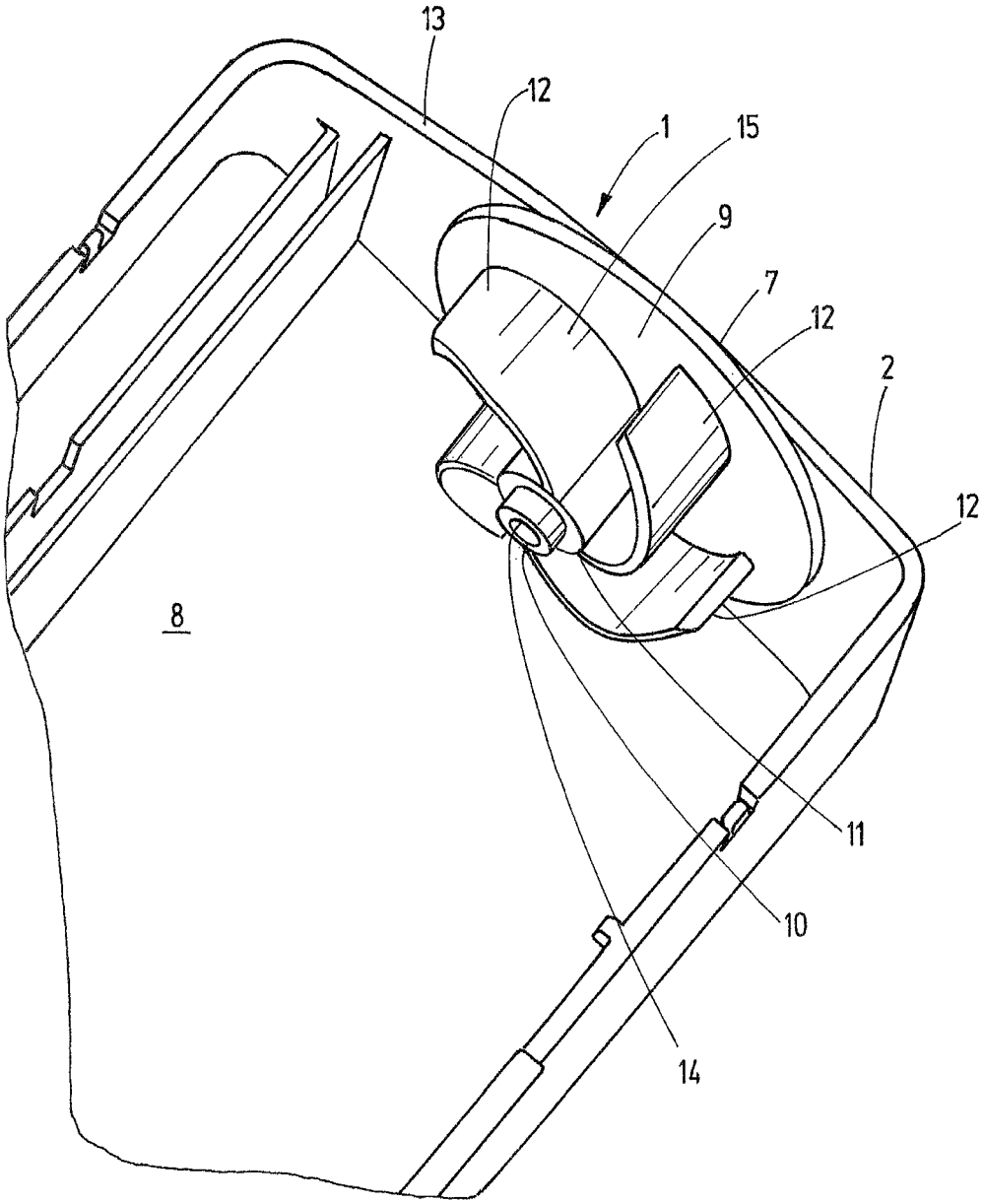
Figure 3:
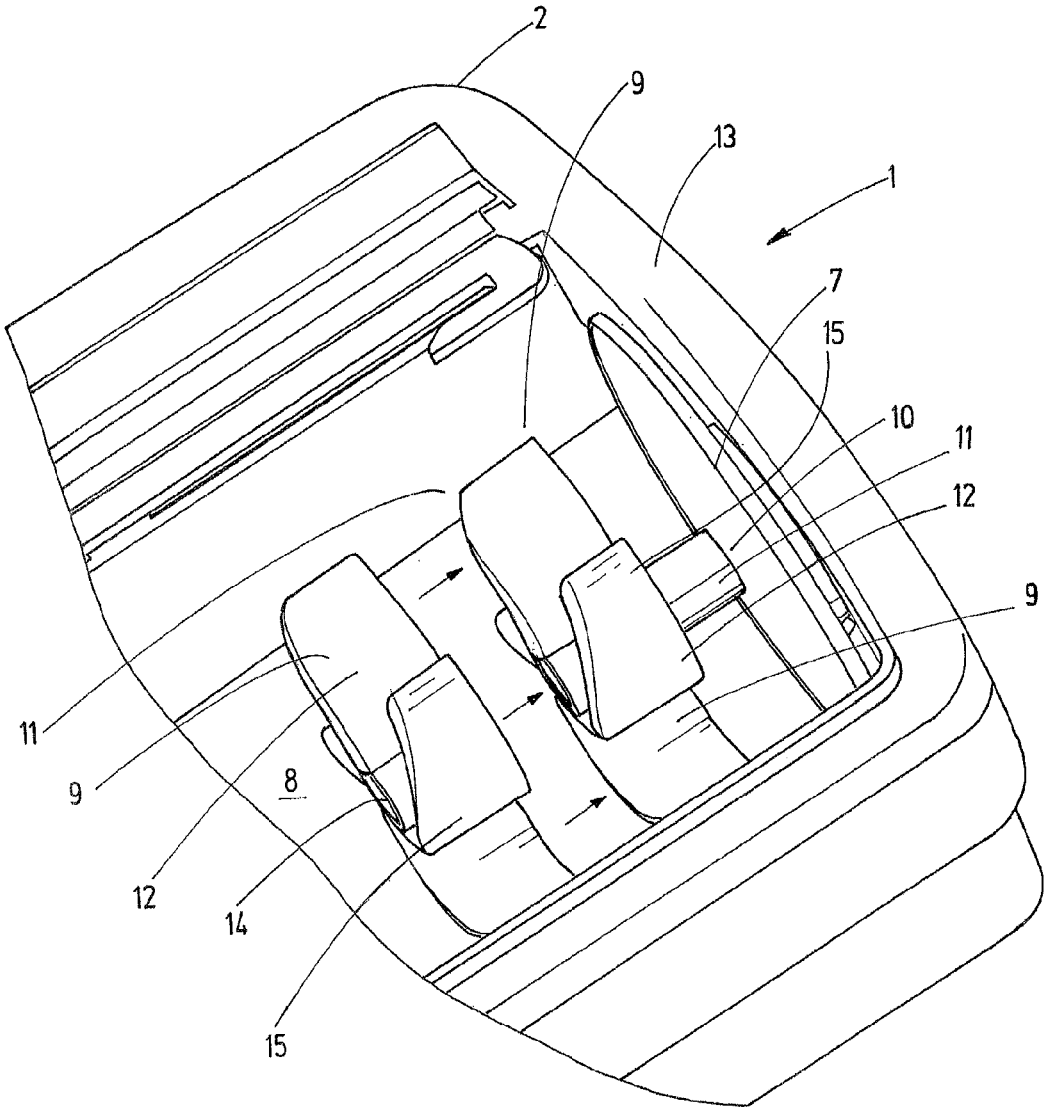

In the following, the invention will be explained in greater detail, using the drawings. These show, in a schematic representation:

FIGS. 1*a* and 1*b* a top view and side view of the unwinder according to the invention, FIG. 2 in a perspective view, a detail from the housing interior, in which the accommodation element according to the invention is disposed, and FIG. 3 the process of pushing or pulling the accommodation element from FIG. 2 onto a crosspiece.

FIG. 1*a*, 1*b* show an unwinder provided with the reference symbol 1.

The unwinder 1 has a housing 2 that is provided with a releasable cover 4 on the top side. The housing 2, produced from plastic, is dimensioned in such a manner that even larger rolls 3 can be laid around the accommodation element 9 with their winding core, so as to rotate. The housing 2 has a length of approximately 340 mm, a width of approximately 840 mm, and a height of approximately 700 mm, and is so wide that it reaches beyond the two face sides of the roll 3.

On its front side, the housing 2 has a cutting apparatus 5 in the form of a blade, and a hinged lid 6. The film on the roll 3 that is laid into the housing 2 is pulled out of the housing 2, as needed, in order to be separated from the roll 3 by means of the cutting apparatus 5. In this connection, the hinged lid 6 is pressed down, in order to allow a clean cut of the film rolled up on the roll 3.

As is furthermore evident from FIG. 1*a*, 1*b*, a disk 7, produced from plastic and connected with the face sides 13, is disposed in the interior of the housing 2, on the two face sides 13, which disk is in one piece and connected, in its center, with a crosspiece 10 that extends into the interior of the housing 2. The crosspiece 10 has a length of approximately 15 mm and is releasably or non-releasably connected with the accommodation element 9.

The surface sections of the accommodation element 9 corresponding to the crosspiece 10, which are shown in FIGS. 2 and 3 and provided with the reference symbol 14, enclose the crosspiece 10.

The accommodation element 9 shown in FIG. 1*a*, 1*b* has outer surfaces that form accommodation surfaces 15 for the film wound up onto the roll 3, at least in part. The accommodation element 9 has a length of approximately 9.5 mm and a diameter of approximately 35 mm, so that even the roll 3, having a larger winding core, is securely held between the two accommodation elements 9. The accommodation elements 9 are consequently dimensioned in such a manner that they adapt more flexibly and also better to a greater width of the roll 3, so that unwinding and cutting of the film is improved.

As is evident from FIG. 2, which shows a detail of the interior 8 of the housing 2, the accommodation element 9 can have arc-shaped projections 12—similar to a paddle wheel—within the scope of a further embodiment of the unwinder 1 according to the invention. Surfaces of the projections 12 having a convex configuration form the accommodation surfaces 15 for the roll 3 shown in FIG. 1*a*, 1*b*.

The projections 12 shown in FIG. 2 are produced from plastic and have a certain elasticity, so that even rolls having winding cores that have slightly different diameters can be accommodated by the accommodation element 9 and thereby held in place. As is furthermore evident from FIG. 2, the end region of the crosspiece 10 that faces away from the disk 7 projects freely for a certain distance. In the embodiment of the unwinder 1 shown in FIG. 2, the crosspiece 10 is sheathed by the accommodation element 9 and firmly connected with it.

A further embodiment of the unwinder 1 provides, as illustrated by FIG. 3, that the accommodation element 9 is releasably connected with the crosspiece 10. Application of the accommodation element 9 takes place in such a manner that the accommodation element 9 is pushed onto the outer surfaces 11 of the crosspiece 10 by means of an axial relative displacement, i.e. a displacement in the direction of the arrows shown in FIG. 3, so that the surface sections 14 and outer surfaces 11 that correspond to one another come to lie against one another. Therefore a retrofitting set that consists of the accommodation element 9 is also available for conventional unwinders.

The present invention is not restricted, in terms of its embodiment, to the exemplary embodiments indicated above. Instead, a number of variants is possible, which make use of the solution presented even for embodiments of a fundamentally different type. For example, the accommodation surfaces of the accommodation elements 9 can have geometries different from the ones shown in the above exemplary embodiments.

REFERENCE SYMBOL LIST

1 unwinder
2 housing
3 rolls
4 cover
5 cutting apparatus
6 hinged lid
7 disk
8 interior
9 accommodation element
10 crosspiece
11 outer surface
12 projections
13 face sides
14 surface sections
15 accommodation surfaces

The invention claimed is:

1. Unwinder comprising:

a housing, first and second crosspieces disposed laterally in the housing, first and second accommodation elements connected to the first and second crosspieces, respectively, and comprising surface sections and accommodation surfaces, and a disk, wherein the surface sections correspond to the first and second crosspieces and enclose the first and second crosspieces, respectively, in releasable or non-releasable manner, and wherein the accommodation surfaces are for the product to be unwound and comprise arc-shaped projections that extend perpendicularly from the disk, that extend from the crosspiece in a radial direction, and that have an elasticity so that an outer diameter of the arc-shaped projections can accommodate different diameters.

2. Unwinder according to claim 1, wherein the housing has a length of at least 340 mm, a width of at least 840 mm, and a height of at least 700 mm.

3. Unwinder according to claim 1, wherein the crosspiece has a length of 15 mm, and wherein the disk is disposed laterally on the face sides of the housing and has a diameter of 45 mm.

4. Unwinder according to claim 3, wherein the accommodation elements have a length of 9.5 mm.

5. Unwinder according to claim 3, wherein the width of the arc-shaped projections amounts to 9.5 mm.

6. Unwinder according to claim 3, wherein the disk and/or the first crosspiece and/or a first accommodation element of the accommodation elements are releasably connected with one another.

7. Unwinder according to claim 1, wherein the diameter of the accommodation elements amounts to 35 mm.

8. Unwinder according to claim 1, wherein the distance between an edge of the disk and an arc-shaped projection of the arc-shaped projections amounts to 10 mm.

* * * * *